US005649327A

United States Patent [19]

Crewe

[11] Patent Number: 5,649,327

[45] Date of Patent: Jul. 22, 1997

[54] CAP/VISOR WITH NECKPIECE RETRACTABLE INTO A POCKET

[76] Inventor: Ian Crewe, 2612 NE. 13th Ct., Fort Lauderdale, Fla. 33304

[21] Appl. No.: 569,057

[22] Filed: Dec. 8, 1995

[51] Int. Cl.[6] ..... A42B 1/06

[52] U.S. Cl. ..... 2/172; 2/181; 2/209.13; 2/DIG. 11

[58] Field of Search ..... 2/172, 175.6, 181, 2/181.6, 209.13, 171, DIG. 11

[56] References Cited

U.S. PATENT DOCUMENTS 1,350,869 8/1920 Kornfeld ..... 2/172

4,593,417 6/1986 Brown ..... 2/209.1

4,980,928 1/1991 Ellis ..... 2/88

5,161,259 11/1992 Shorts ..... 2/199

*Primary Examiner*—Diana Biefeld

*Attorney, Agent, or Firm*—Alvin S. Blum

[57] ABSTRACT

A cap, hat, or visor is provided with a headband. The headband has an inner face for engaging the head of a wearer and an outer face. An elongate pocket is formed in the outer face portion of the headband extending along at least half of the headband circumference. An outer closure in the pocket shields the pocket contents from view and contamination. A foldable neckpiece is attached to the interior of the pocket. It may be folded up and contained within the pocket or unfolded to protectively cover the ears and neck. The neckpiece may be detachable for laundering.

11 Claims, 1 Drawing Sheet

CAP/VISOR WITH NECKPIECE RETRACTABLE INTO A POCKET

FIELD OF THE INVENTION

This invention relates to hats, caps and visors, and more particularly, to such apparel provided with a protective panel that may be concealed within a pocket and deployed therefrom to protect the neck of the wearer from the elements.

BACKGROUND OF THE INVENTION

U.S. Pat. No. 5,161,259 issued Nov. 10, 1992 to Shorts discloses a neck covering cape or flap that is removably attachable to a baseball type cap by a strap to protect the neck from the sun. U.S. Pat. No. 4,980,928 issued Jan. 1, 1991 to Ellis discloses a neck and shoulder covering cape that is stowable within the inner lining of the hat. This makes the hat with stowed cape a much tighter fit than the hat with cape deployed. U.S. Pat. No. 4,593,417 issued Jun. 10, 1986 to Brown discloses a flap which covers face and neck when deployed and sticks onto the outside crown when retracted where it is exposed and forms extra layers atop the cap.

A hat, cap or visor that removably protects the wearer's neck when desired and that retracts the neck covering in a manner that shields it from view and exposure without altering the fit of the cap would be a desirable improvement in the art.

SUMMARY OF THE INVENTION

It is, accordingly, an object of the invention to provide a hat, cap or visor having a neck covering piece that is easily deployed to protect the users neck from the elements such as sun, rain, snow, dirt, and the like. It is another object that the neckpiece be easily stowable within a closable pocket on the outside of the hat, cap or visor without affecting the fit of the headgear. It is yet another object that the neckpiece be readily detachable for cleaning.

The headgear of the invention comprises a hat, cap or visor having an elongate, closable, external pocket. The neckpiece is removably attached within the pocket and unfurls therefrom to cover the ears and neck as desired. The neckpiece may be furled and stowed within the pocket and the pocket closed when the neckpiece is not in use. The closure of the pocket conceals the neckpiece and protects it from soiling or wetting when not in use.

These and other objects, advantages and features of the invention will become more apparent when the detailed description is studied in conjunction with the drawings, in which like reference characters refer to like elements in the various figures.

DETAILED DESCRIPTION OF PREFERRED EMBODIMENTS

Figure 1:
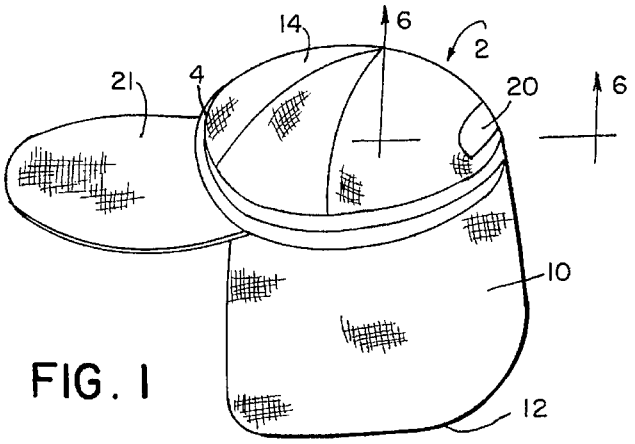
FIG. 1 is a perspective view of a cap of the invention with neckpiece unfurled.
Figure 3:
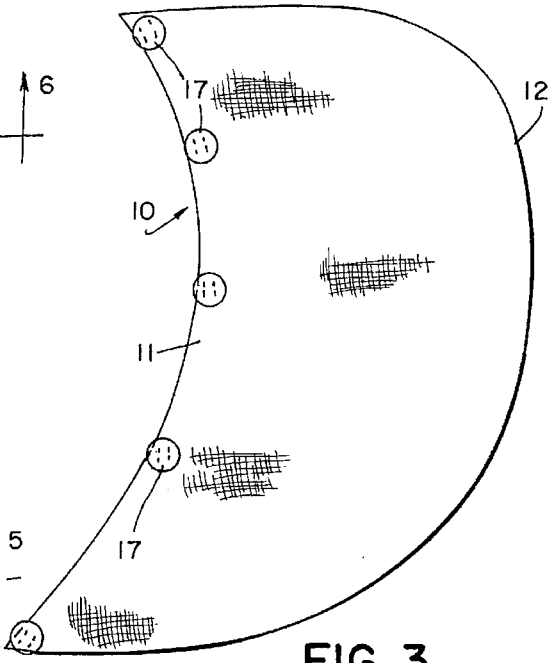
FIG. 3 is a top plan view of the detached neckpiece.
Figure 6:
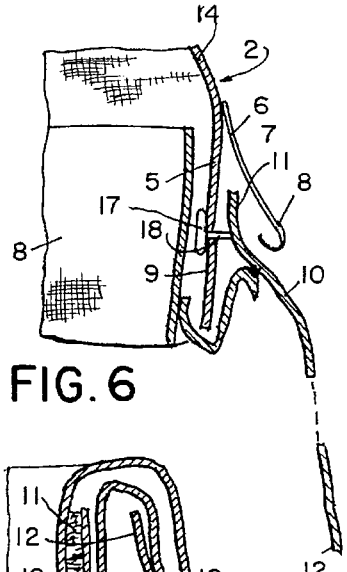
FIG. 6 is a sectional view taken through line 6—6 of FIG. 1.

Referring now first to FIGS. 1, 3, and 6, the head covering comprises a headband 4, a forwardly directed brim 21 attached to the front of the headband, and a crown piece 14, the assembly being often referred to as a cap 2 or hat. When the crown piece is absent, the assembly is then often referred to as a visor. An aperture 20 may be provided in crown piece 14 to pass a pony tail hair portion therethrough. The headband 4 comprises an inner face portion 5, and an outer face portion 6, defining an elongate pocket 7 therebetween, the pocket extends along about at least one half of the circumference of the headband. The inner face 5 of the headband is adapted to engage the head of the wearer to hold the head covering 2 in place. It determines the fit of the head covering.

A thin, foldable neck covering piece 10 has a top edge 11 and a free bottom edge 12. The top edge 11 is attached by attaching means to the interior 9 of the pocket 7. In this case buttons 17 engage button holes 18. Other removable attaching means well known in the art may be alternatively employed such as snaps, zippers, and hook and loop fasteners so that the neck covering piece may be detached for laundering. Alternatively, the neckpiece may be permanently sewn in place. When the neck covering piece is unfurled, the free end 12 hangs downward and the ears and neck are shielded from undesirable environmental elements such as dirt, sun, rain and the like. When the neck covering piece is rolled or folded up, i.e. furled, it fits inside interior 9 of the pocket 7. The outer closure 8, here a zippered flap, is then closed to conceal the piece 10 and protect it from the elements.

Figure 2:
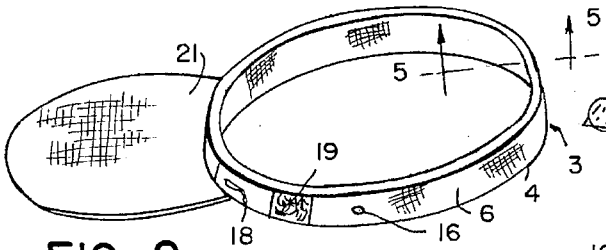
FIG. 2 is a perspective view of a visor of the invention with neckpiece furled and concealed within the headband.
Figure 5:
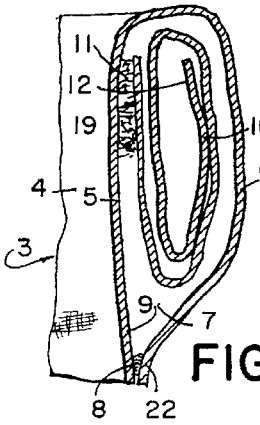
FIG. 5 is a sectional view taken through line 5—5 of FIG. 2.

Referring now to FIGS. 2 and 5, the visor 3 of the invention comprises a headband 4 and a forwardly directed brim 21 attached thereto. The headband 4 comprises an inner face portion 5 and an outer face portion 6 defining therebetween an elongate pocket 7 having an interior surface 9 to which the upper edge 11 of the neck covering piece is attached. The outer face portion 6 is equipped at its lower edge with closure means 8 to close off the pocket and conceal and protect the folded up piece 10 therein. The closure means 8 may be any of the means well known in the art. In FIG. 2, a portion of the outer facing 6 is broken away and the piece 10 removed to show buttonhole 18, hook and loop fastener 19 and snap fastener 16 which may be used to removably attach the piece 10. Pocket closure means 8 shown here is a snap fastener.

Figure 4:
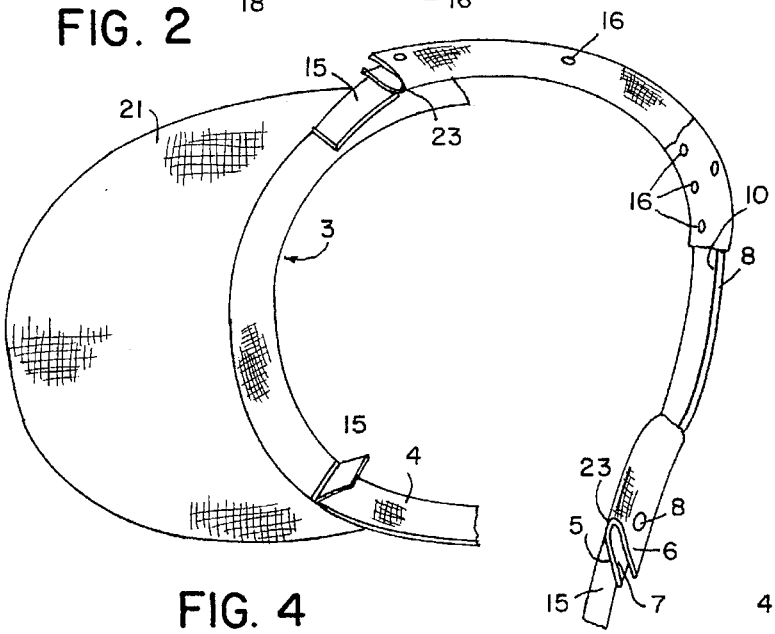
FIG. 4 is a top view of another embodiment of the invention with neckpiece furled and concealed and portions broken away.

Referring now to the visor 3 of FIG. 4, having a brim 21, the headband 4 is provided with elastic strips 15 to fit heads of different circumferences. One of the strips has been broken away for illustrative purposes. The elongate pocket 7 is formed by an inner face portion 5 and an outer face portion 6 with snaps 8 around the lower edge 22. A portion of the outer face 6 is broken away to show the folded piece 10 therein and a portion of piece 10 is removed to show the snaps 16 also used for removably attaching the piece 10. The ends 23 of the pocket are sewn to the elastic strips.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. A head covering comprising:

A) a headband having a circumference said headband being comprised of an inner face portion for contacting the head of a wearer and an outer face portion;

B) an elongate pocket formed between the outer face portion and the inner face portion and extending along at least one half of the circumference, the pocket having an interior and a closure means for closing the pocket and shielding from contamination the interior thereof; and C) a foldable neck covering piece having a top edge and a bottom edge, and made of a material suitable for protecting the neck and ears of a wearer, the top edge being attached to the interior of the pocket, the neck covering piece being adapted to shield the neck and ears of a wearer when the neck covering is unfurled and the bottom edge depends freely downward from the headband, the neck covering piece being adapted to fold up and fit inside the pocket and be concealed and protected by closure of the pocket by the closure means.

2. The covering according to claim 1, further comprising attaching means for removably attaching the neck covering piece to the interior of the pocket.

3. The covering according to claim 2, in which the attaching means is selected from the group consisting of buttons, zippers, snaps and hook-and-loop fasteners.

4. The invention according to claim 3, in which the closure means is selected from the group consisting of zippers, buttons, snaps and hook-and-loop fasteners.

5. The invention according to claim 1, in which the closure means is selected from the group consisting of zippers, buttons, snaps and hook-and-loop fasteners.

6. The covering according to claim 1, further comprising a visor attached to the headband.

7. The covering according to claim 6, further comprising a crown piece attached to the headband.

8. The covering according to claim 1, in which the headband is provided with elastic means for adjusting the circumference of the headband to fit heads of different sizes.

9. A head covering comprising:

A) a headband having an outer face portion and an inner face portion, the inner face portion defining a circumference for fitting the head of a wearer;

B) an elongate pocket formed between the outer face portion and the inner face portion and extending along at least about one half of the circumference, the pocket having an interior and a closure means for closing the pocket and shielding from view and contamination the interior thereof, the closure means being outward of the inner face portion; and C) a foldable neck covering piece having a top edge and a bottom edge, and made of a material suitable for protecting the neck and ears of a wearer, the top edge being attached to the interior of the pocket, the neck covering piece being adapted to shield the neck and ears of a wearer when the neck covering piece is unfurled and the bottom edge depends freely downward from the headband, the neck covering piece being adapted to fold up and fit inside the pocket and be concealed and protected by closure of the pocket by the closure means, without changing the circumference defined by the inner face portion.

10. The covering according to claim 9, further comprising attaching means for removably attaching the neck covering piece to the interior of the pocket.

11. The covering according to claim 10, in which the headband is provided with elastic means for adjusting the circumference of the headband to fit heads of different sizes.

* * * * *